US011939973B1

(12) United States Patent
Xu

(10) Patent No.: US 11,939,973 B1
(45) Date of Patent: Mar. 26, 2024

(54) AIR PUMP WITH AUTOMATIC AIR PUMPING FUNCTION

(71) Applicant: ZHEJIANG SHIJING TOOLS CO., LTD, Wuyi (CN)

(72) Inventor: Shuaijie Xu, Wuyi (CN)

(73) Assignee: ZHEJIANG SHIJING TOOLS CO., LTD, Wuyi (CN)

( * ) Notice: Subject to any disclaimer, the term of this patent is extended or adjusted under 35 U.S.C. 154(b) by 0 days.

(21) Appl. No.: 18/513,574

(22) Filed: Nov. 19, 2023

(51) Int. Cl.

| | |
|---|---|
| ***F04B 49/06*** | (2006.01) |
| ***F04B 35/04*** | (2006.01) |
| ***F04B 35/06*** | (2006.01) |
| ***F04B 39/12*** | (2006.01) |
| ***F04B 49/00*** | (2006.01) |
| ***F04B 49/02*** | (2006.01) |
| ***F04B 49/08*** | (2006.01) |

(52) U.S. Cl.
CPC ..... *F04B 49/06* (2013.01); *F04B 35/04* (2013.01); *F04B 35/06* (2013.01); *F04B 39/12* (2013.01); *F04B 39/121* (2013.01); *F04B 39/123* (2013.01); *F04B 49/00* (2013.01); *F04B 49/022* (2013.01); *F04B 49/065* (2013.01); *F04B 49/08* (2013.01); *F04B 2205/03* (2013.01); *F04B 2205/04* (2013.01); *F04B 2205/05* (2013.01)

(58) Field of Classification Search
CPC ..... F04B 49/06; F04B 35/04; F04B 35/06; F04B 39/12; F04B 39/121; F04B 39/123; F04B 49/00; F04B 49/022; F04B 49/065; F04B 49/08; F04B 2205/03; F04B 2205/04; F04B 2205/05
See application file for complete search history.

(56) References Cited

U.S. PATENT DOCUMENTS

| | | | | |
|---|---|---|---|---|
| 2,960,321 | A * | 11/1960 | Stoots, Jr. | A01K 63/042 261/122.1 |
| 4,033,511 | A * | 7/1977 | Chamberlin | B05B 7/2418 239/351 |
| 5,127,808 | A * | 7/1992 | Nichols | B62J 11/02 417/234 |
| 5,639,226 | A * | 6/1997 | Boutrup | F04B 35/04 417/462 |
| 7,556,478 | B2 * | 7/2009 | Klein | F04B 35/04 417/44.1 |
| 7,766,631 | B2 * | 8/2010 | Kitahara | F04B 39/0016 417/547 |
| 10,173,483 | B2 * | 1/2019 | Neir | A63B 41/12 |
| 11,002,264 | B2 * | 5/2021 | Komiya | F04B 35/04 |
| 2006/0140759 | A1 | 6/2006 | Tsai | |
| 2009/0010774 | A1 * | 1/2009 | Fish | F04C 2/16 417/410.1 |
| 2011/0280752 | A1 | 11/2011 | Ishibashi et al. | |
| 2013/0189136 | A1 | 7/2013 | Chu | |

* cited by examiner

*Primary Examiner* — Peter J Bertheaud
(74) *Attorney, Agent, or Firm* — Zhigang Ma

(57) ABSTRACT

The present disclosure relates to the technical field of air pumps on vacuum suction cups, and in particular, to an air pump with an automatic air pumping function. The air pump includes a shell and a sealing ring; an automatic air replenishing mechanism is arranged at one end of the shell, and the other end of the shell is sleeved with a mounting barrel; the automatic air replenishing mechanism includes a battery mounting box mounted on an inner wall of the shell; and a battery pack is arranged inside the battery mounting box.

9 Claims, 9 Drawing Sheets

AIR PUMP WITH AUTOMATIC AIR PUMPING FUNCTION

TECHNICAL FIELD

The present disclosure relates to the technical field of air pumps on vacuum suction cups, and in particular, to an air pump with an automatic pumping function.

BACKGROUND

An air pump is commonly used pump equipment, which is mainly configured to pump air and achieves a negative pressure or a positive pressure by increasing or decreasing a volume. The air pump is used in many products, such as a clothing storage and a vacuum suction cup. The air pump is used in the vacuum suction cup more frequently. Workers need to transport tiles during house decoration nowadays. Therefore, it is a common way to combine an air pump with a vacuum suction cup to transport tiles, which can achieve safe and efficient transferring of tiles, and can also assist the workers in tile laying according to the principle of the air pump.

During use of the vacuum suction cup nowadays, the air pump needs to be used to pump out air of a vacuum suction cup and tile contact surface to form a negative pressure inside, so that a worker can lift up the tile. However, during the transferring and movement, external air easily enters from a space between the vacuum suction cup and the tile. The air pump on the existing vacuum suction cup cannot automatically perform an air pumping operation when an air pressure value changes, which easily causes unfirmness between the tile and the vacuum suction cup and even causes the tile to fall off.

Therefore, an air pump with an automatic air pumping function is proposed to solve the above problems.

SUMMARY

The present disclosure aims to provide an air pump with an automatic air pumping function to solve the problems described above, which improves the following problems: An air pump on an existing vacuum suction cup cannot automatically perform an air pumping operation when an air pressure value changes, which easily causes unfirmness between a tile and the vacuum suction cup and even causes the tile to fall off.

The above objective of the present disclosure is achieved by the following technical solutions: An air pump with an automatic air pumping function includes a shell and a sealing ring, wherein an automatic air replenishing mechanism is arranged at one end of the shell, and the other end of the shell is sleeved with a mounting barrel.

Preferably, the automatic air replenishing mechanism includes a battery mounting box mounted on an inner wall of the shell; a battery pack is arranged inside the battery mounting box; a vacuum pump is arranged on the inner wall of the shell; one end of the shell is clamped with a detection box; an air pressure sensor is arranged inside the detection box; a two-way valve communicated with the vacuum pump is embedded into the other end of the detection box; the sealing ring sleeves a surface of the detection box; a shape of the sealing ring is a hollow circular truncated cone; a digital display circuit board is arranged on a surface of the battery mounting box; and an output end of the battery pack is electrically connected to an input end of the digital display circuit board. During use of the device, the automatic air replenishing mechanism in the device can use the air pressure sensor to automatically detect an air pressure in an inner cavity of a suction cup; when an air pressure value changes, the intensity of a negative pressure will change; the vacuum pump automatically runs to pump air from the device; and meanwhile, the air pressure sensor can make air pumping more intelligent, and the process runs automatically during the use of the device without manual control, so that tiles will not be separated from the vacuum suction cup during transferring or laying.

Preferably, the automatic air replenishing mechanism further includes a digital display board arranged on a surface of the mounting barrel; the digital display board and the digital display circuit board are electrically connected in both directions; the other end of the mounting barrel is provided with a switch; and the switch is electrically connected to the battery pack. The digital display board can display values such as the air pressure value, and an operator can also view states more intuitively. This makes the device more convenient to use. At the same time, to facilitate a user to use the product, when a battery runs out during electric air pumping, the user can use a manual air pumping function.

Preferably, an O-ring is arranged on a surface of an end portion of the two-way valve; an outer wall of the O-ring is in close contact with the detection box; and the O-ring is a rubber material member. The O-ring can improve the sealing performance between the two-way valve and the detection box, reduce air leakage of the device, and also adjust the air pressure value more stably.

Preferably, a hose is arranged between the two-way valve and the vacuum pump, and an end portion of the hose penetrates through the detection box. The hose can be disassembled and removed according to a situation, so that the device is more convenient to disassemble.

Preferably, the inner wall of the shell is fixedly connected with two mounting blocks; and two L-shaped mounting slots matched with the mounting blocks are formed in the surface of the detection box. The mounting blocks are first placed at notches of the L-shaped mounting slots. After movement for a period of time, the detection box is rotated to achieve the mounting operation, making mounting and removal more convenient.

Preferably, the inner wall of the shell is provided with a connecting plate; and the connecting plate is connected to one end of the vacuum pump. The connecting plate can be used to limit the vacuum pump, so that the vacuum pump is more stable in the shell.

Preferably, a round hole is formed in a middle position of the other end of the mounting barrel, and a size of the round hole is matched with a size of the switch.

Preferably, the air pressure sensor is electrically connected to the digital display circuit board; and a sensing range of the air pressure sensor is from 0 kPa to 90 kPa at a negative pressure.

Beneficial effects of the present disclosure are as follows:

1. During use of the device, the automatic air replenishing mechanism in the device can use the air pressure sensor to automatically detect an air pressure in an inner cavity of a suction cup; when a negative pressure value changes, a displayed numeral of a weight of goods that can be transferred will change; when a negative pressure is less than a certain value, the vacuum pump automatically runs to replenish air into the inner cavity of the suction cup; meanwhile, the air pressure sensor can make air pumping more intelligent, and the process runs automatically during the use of the device without manual control, so that tiles will not be separated from the vacuum suction cup during transferring or laying. The digital display board can display values such as the air pressure value, and an operator can also view states more intuitively. This makes the device more convenient to use.

2. The O-ring can improve the sealing performance between the two-way valve and the detection box, reduce air leakage of the device, and also adjust the air pressure value more stably. The mounting blocks are first placed at notches of the L-shaped mounting slots. After movement for a period of time, the detection box is rotated to achieve the mounting operation, making mounting and removal more convenient.

Figure 1:
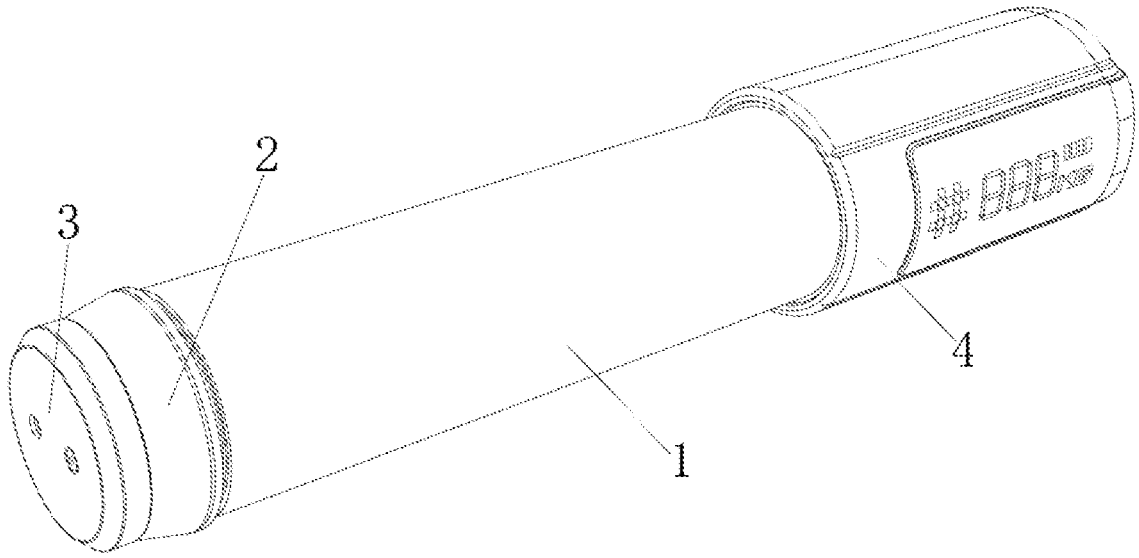
FIG. 1 is a schematic diagram of an entire structure of the present disclosure.

In the drawings: 1: shell; 101: mounting block; 102: connecting plate; 2: sealing ring; 3: automatic air replenishing mechanism; 301: battery mounting box; 302: battery pack; 303: vacuum pump; 304: detection box; 305: air pressure sensor; 306: two-way valve; 307: digital display circuit board; 308: digital display board; 309: switch; 310: O-ring; 311: hose; 312: mounting slot; 4: mounting barrel; and 401: round hole.

DETAILED DESCRIPTION OF THE EMBODIMENTS

The technical solutions in the embodiments of present disclosure are clearly and completely described below with reference to the accompanying drawings in the embodiments of present disclosure. Apparently, the described embodiments are merely some rather than all of the embodiments of present disclosure. All other embodiments obtained by a person of ordinary skill in the art based on the embodiments of present disclosure without making creative efforts shall fall within the protection scope of present disclosure.

Figure 2:
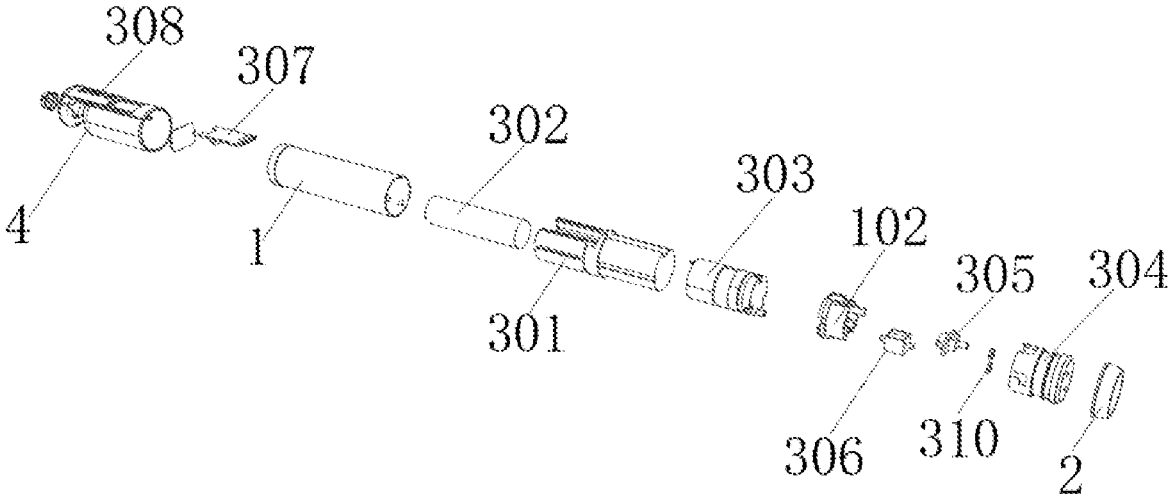
FIG. 2 is an overall exploded view of the present disclosure.
Figure 3:
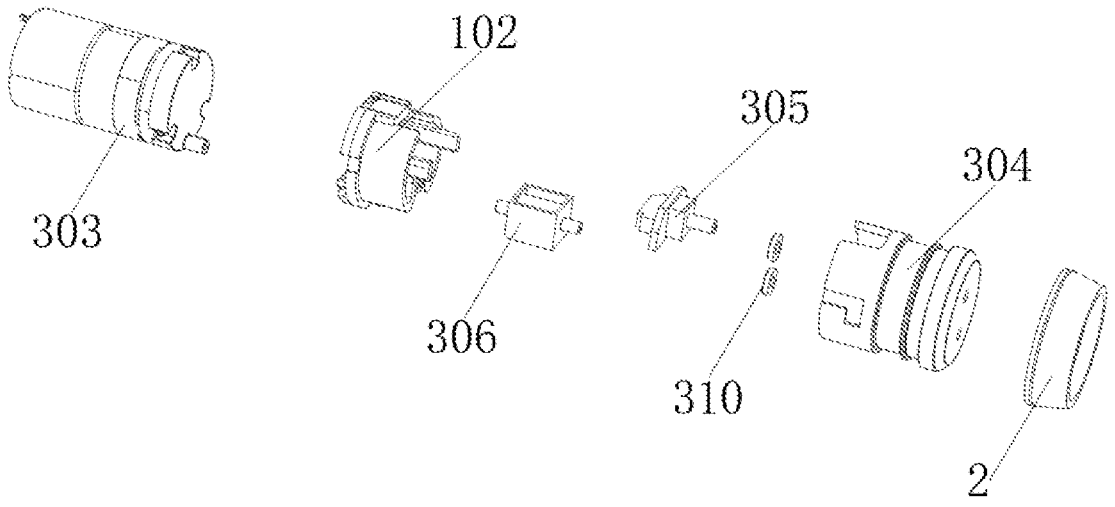
FIG. 3 is an exploded diagram of a detection portion of the present disclosure.
Figure 4:
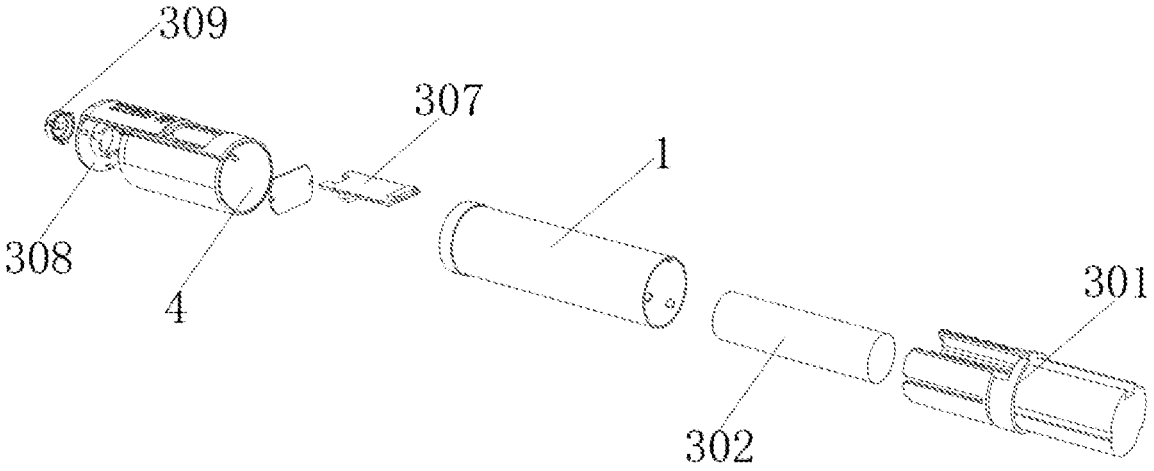
FIG. 4 is an exploded diagram of a battery portion of the present disclosure.
Figure 5:
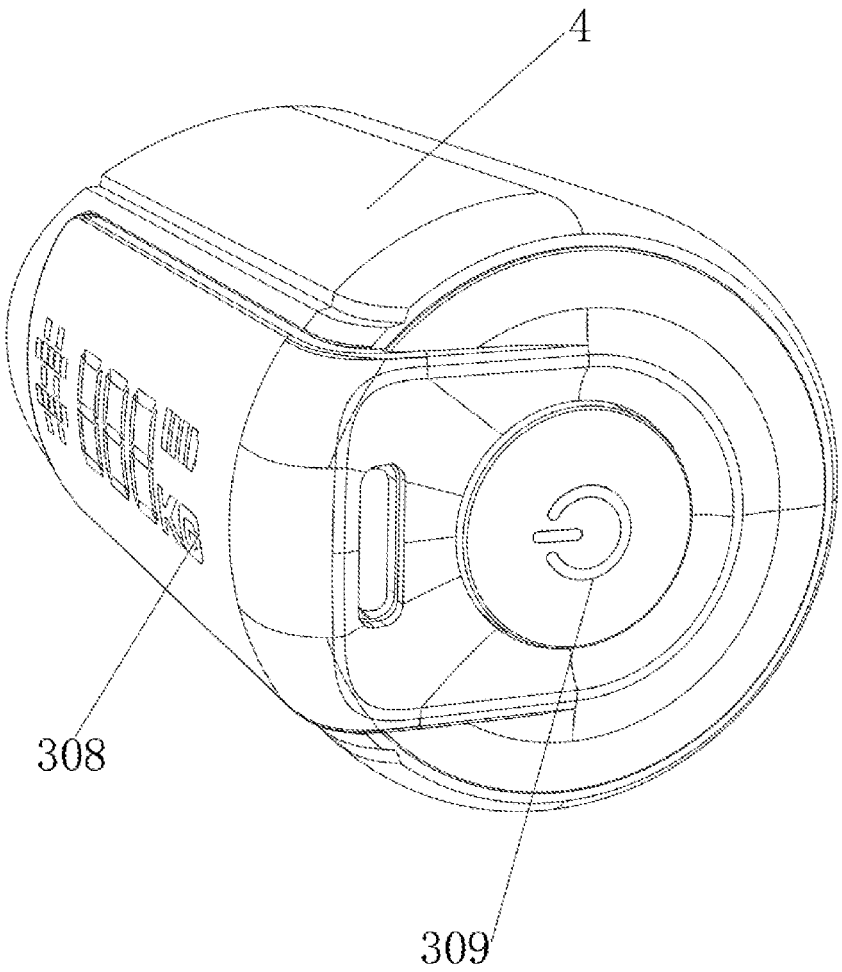
FIG. 5 is a schematic diagram of a side-view structure of the present disclosure.
Figure 6:
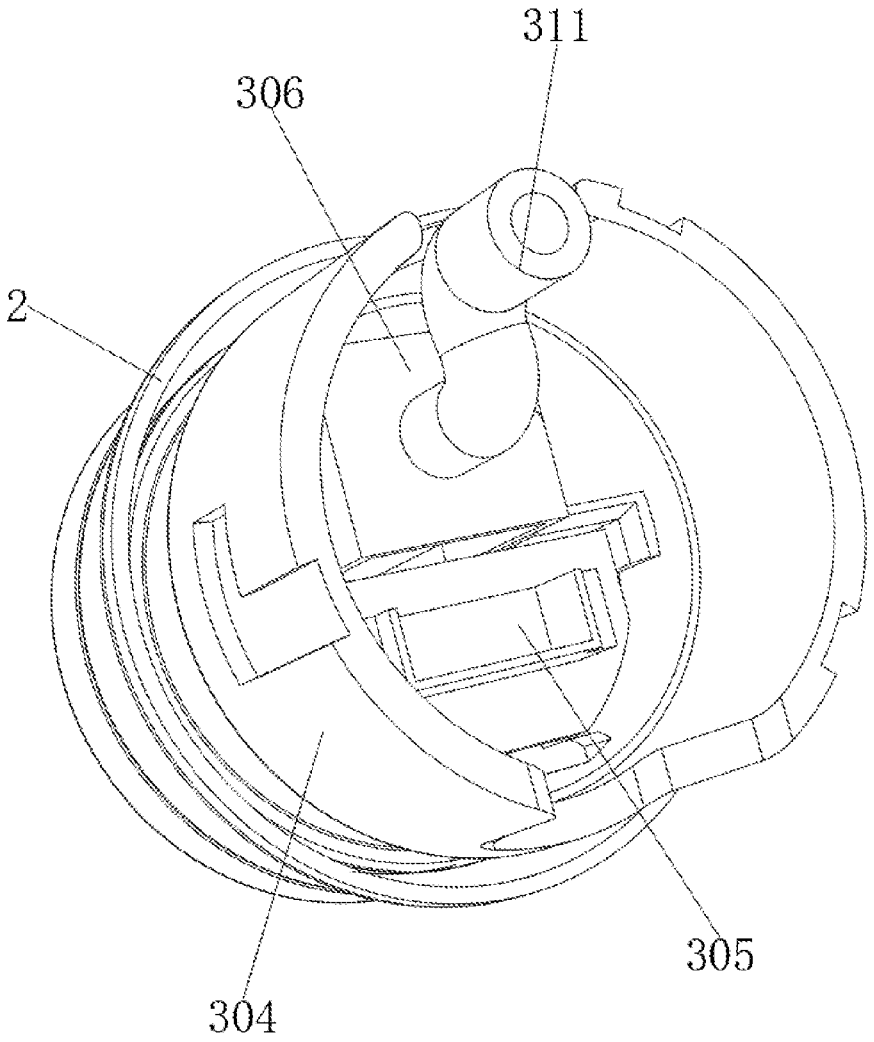
FIG. 6 is a schematic diagram of an internal structure of the present disclosure.
Figure 7:
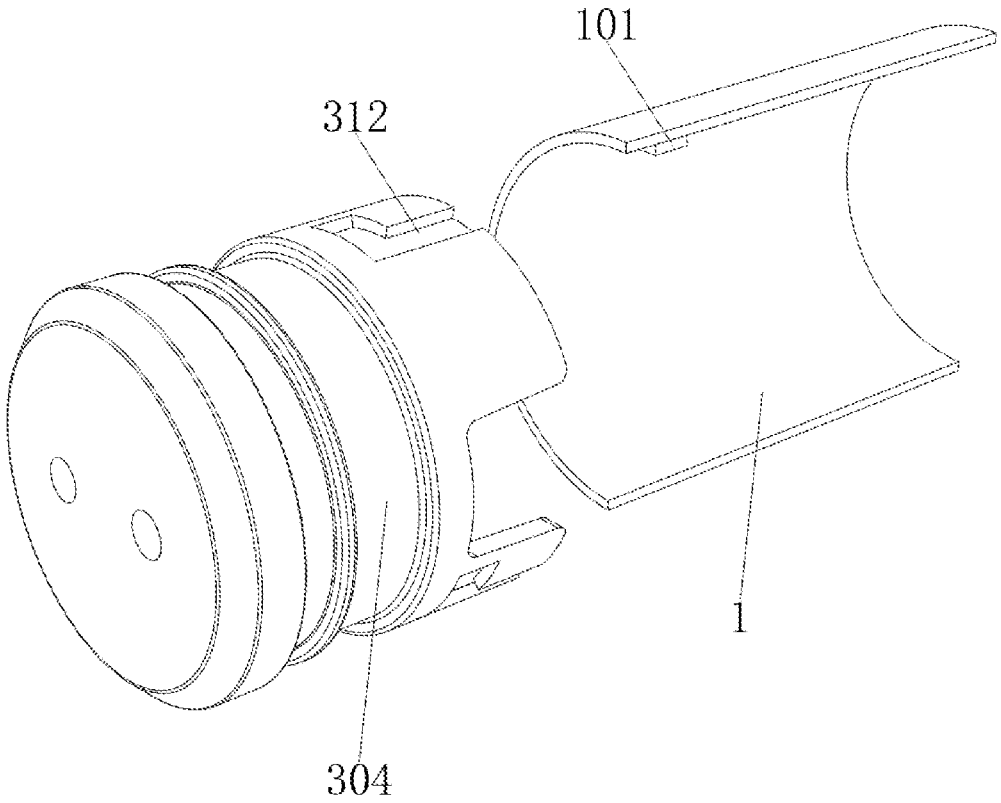
FIG. 7 is a schematic diagram of connection between a detection box and a shell of the present disclosure.
Figure 8:
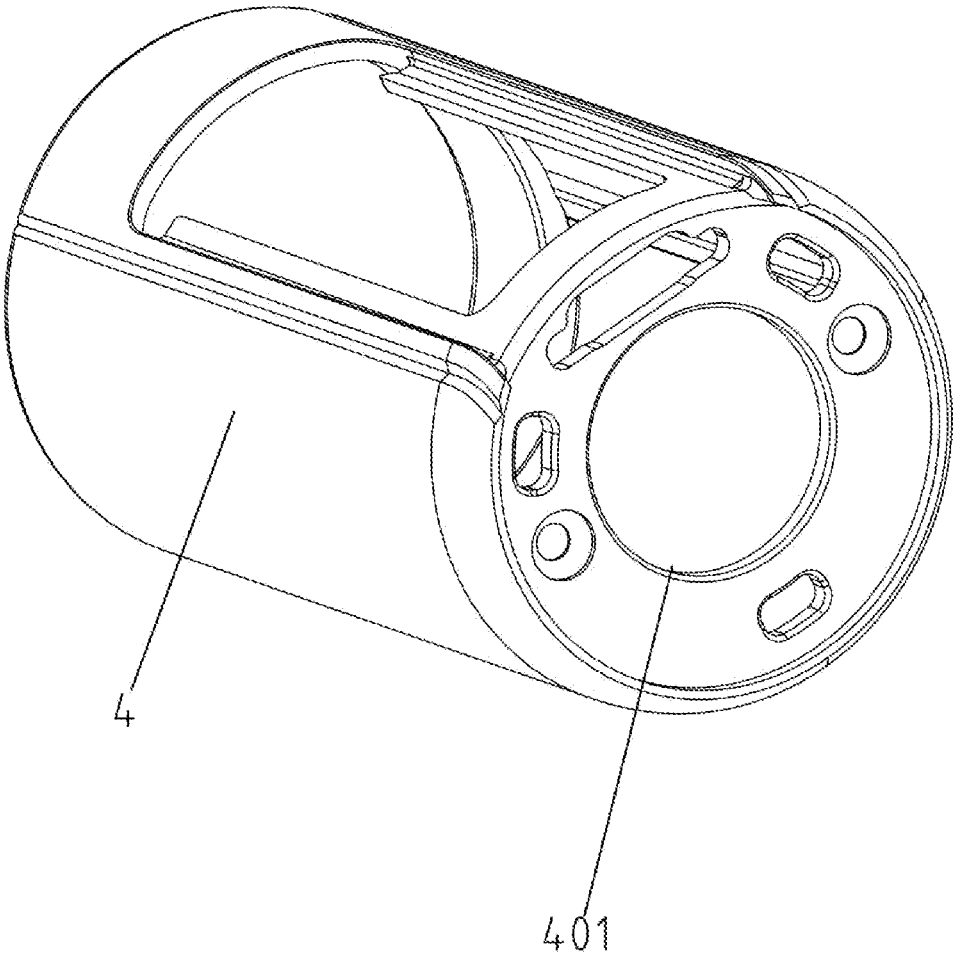
FIG. 8 is a schematic structural diagram of a mounting barrel of the present disclosure.
Figure 9:
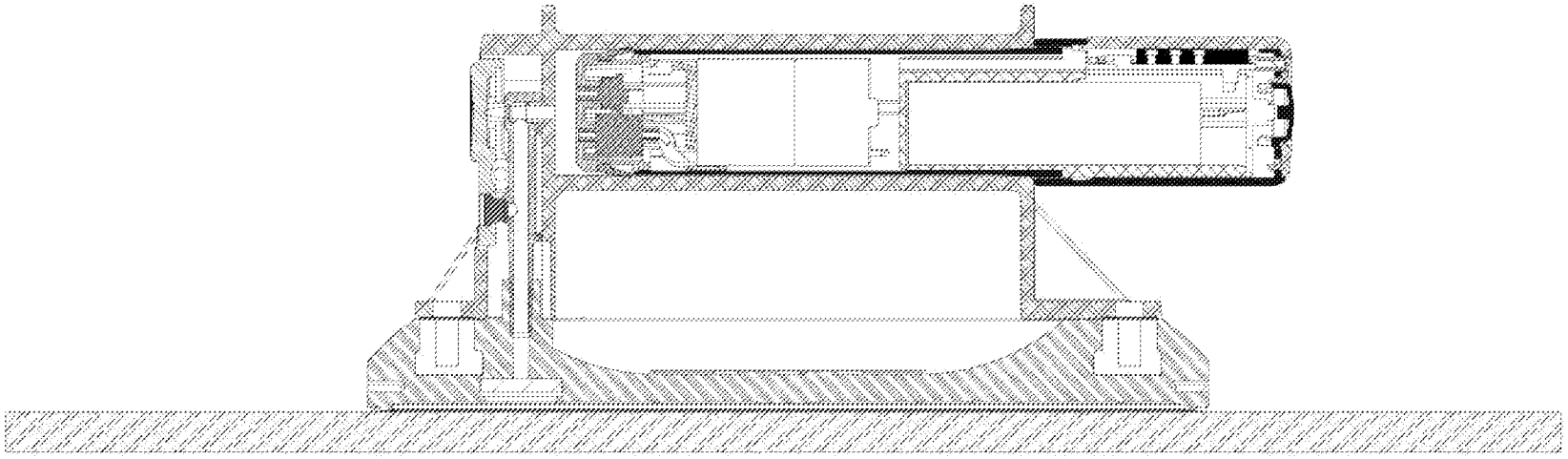
FIG. 9 is a sectional view of an air pump and a vacuum suction cup of the present disclosure.

During specific implementation, as shown in FIG. 1 to FIG. 9, an air pump with an automatic air pumping function includes a shell 1 and a sealing ring 2; an automatic air replenishing mechanism 3 is arranged at one end of the shell 1; a mounting barrel 4 sleeves the other end of the shell 1; the automatic air replenishing mechanism 3 includes a battery mounting box 301 mounted on an inner wall of the shell 1; a battery pack 302 is arranged inside the battery mounting box 301; a vacuum pump 303 is arranged on the inner wall of the shell 1; one end of the shell 1 is clamped with a detection box 304; an air pressure sensor 305 is arranged inside the detection box 304; a two-way valve 306 communicated with the vacuum pump 303 is embedded into the other end of the detection box 304; the sealing ring 2 sleeves a surface of the detection box 304; a shape of the sealing ring 2 is a hollow circular truncated cone; a digital display circuit board 307 is arranged on a surface of the battery mounting box 301; and an output end of the battery pack 302 is electrically connected to an input end of the digital display circuit board 307. During transferring of tiles or when a vacuum suction cup and an air pump need to be used in other aspects, the vacuum suction cup and the air pump are first mounted using the sealing ring 2. The device is first used to make the vacuum suction cup in a set negative pressure state. During use, the air pressure sensor 305 can monitor an air pressure in real time. If an air pressure value is less than a preset value, the air pressure sensor 305 may transmit a signal to the digital display circuit board 307. The digital display circuit board 307 transmits the signal to the vacuum pump 303, and the battery pack 302 provides a driving force for the vacuum pump 303. The two-way valve 306 is used for air pumping, so that an internal pressure reaches a preliminary preset value, and a negative pressure state is achieved.

During use of the device, the automatic air replenishing mechanism 3 in the device can use the air pressure sensor 305 to automatically detect an air pressure in an inner cavity of the suction cup; when the air pressure value changes, the intensity of the negative pressure will change; the vacuum pump 303 automatically runs to pump air from the device; and meanwhile, the air pressure sensor 305 can make air pumping more intelligent, and the process runs automatically during the use of the device without manual control, so that tiles will not be separated from the vacuum suction cup during transportation or laying.

As shown in FIG. 1 to FIG. 8, the automatic air replenishing mechanism 3 further includes a digital display board 308 arranged on a surface of the mounting barrel 4; the digital display board 308 and the digital display circuit board 307 are electrically connected in both directions; the other end of the mounting barrel 4 is provided with a switch 309; and the switch 309 is electrically connected to the battery pack 302. The digital display board 308 can display values such as the air pressure value, and an operator can also view states more intuitively. This makes the device more convenient to use. At the same time, to facilitate a user to use the product, when a battery runs out during electric air pumping, the user can use a manual air pumping function. An O-ring 310 is arranged on a surface of an end portion of the two-way valve 306; an outer wall of the O-ring 310 is in close contact with the detection box 304; and the O-ring 310 is a rubber material member.

A hose 311 is arranged between the two-way valve 306 and the vacuum pump 303, and an end portion of the hose 311 penetrates through the detection box 304. The hose 311 can be disassembled and removed according to a situation, so that the device is more convenient to disassemble. The inner wall of the shell 1 is fixedly connected with two mounting blocks 101; and two L-shaped mounting slots 312 matched with the mounting blocks 101 are formed in the surface of the detection box 304. The mounting blocks 101 are first placed at notches of the L-shaped mounting slots 312. After movement for a period of time, the detection box 304 is rotated to achieve the mounting operation, making mounting and removal more convenient.

A negative pressure value of the air pressure sensor 305 is between 500 MMhg and 200 MMhg. The inner wall of the shell 1 is provided with a connecting plate 102; and the connecting plate 102 is connected to one end of the vacuum pump 303. A round hole 401 is formed in a middle position of the other end of the mounting barrel 4, and a size of the round hole 401 is matched with a size of the switch 309. The air pressure sensor 305 is electrically connected to the digital display circuit board 307; and a sensing range of the air pressure sensor 305 is from 0 kPa to 90 kPa at a negative pressure.

During use of the present disclosure, during transferring of tiles or when a vacuum suction cup and an air pump need to be used in other aspects, the vacuum suction cup and the air pump are first mounted using the sealing ring 2. The device is first used to make the vacuum suction cup in a set negative pressure state. During use, the air pressure sensor 305 can monitor an air pressure in real time. If an air pressure value is less than a preset value, the air pressure sensor 305 may transmit a signal to the digital display circuit board 307. The digital display circuit board 307 transmits the signal to the vacuum pump 303, and the battery pack 302 provides a driving force for the vacuum pump 303. The two-way valve 306 is used for air pumping, so that an internal pressure reaches a preliminary preset value, and a negative pressure state is achieved. Meanwhile, the digital display board 308 can display values such as the air pressure value, and an operator can also view states more intuitively. This makes the device more convenient to use.

It should be noted that the battery pack, the vacuum pump, the air pressure sensor, the two-way valve, the digital display circuit board, and the digital display board mentioned in the above descriptions are all mature devices applied in the prior art. Specific models can be selected according to actual needs. At the same time, the battery pack, the vacuum pump, the air pressure sensor, the two-way valve, the digital display circuit board, and the digital display board can be powered by a built-in power source or a mains supply. A specific power supplying way depends on a situation, and will not be elaborate here.

In addition, it should be understood that although this specification is described according to the implementations, not each implementation only includes one independent technical solution. This narration method of this specification is only for clarity. A person skilled in the art should regard this specification as a whole, and the technical solutions in the respective embodiments can also be appropriately combined to form other implementations that can be understood by a person skilled in the art.

What is claimed is:

1. An air pump with an automatic air pumping function, comprising a shell (1) and a sealing ring (2), wherein an automatic air replenishing mechanism (3) is arranged at one end of the shell (1), and the other end of the shell (1) is sleeved with a mounting barrel (4);

the automatic air replenishing mechanism (3) comprises a battery mounting box (301) mounted on an inner wall of the shell (1); a battery pack (302) is arranged inside the battery mounting box (301); a vacuum pump (303) is arranged on the inner wall of the shell (1); one end of the shell (1) is clamped with a detection box (304); an air pressure sensor (305) is arranged inside the detection box (304); a two-way valve (306) communicated with the vacuum pump (303) is embedded into an end of the detection box (304); the sealing ring (2) sleeves onto a surface of the detection box (304); a shape of the sealing ring (2) is a hollow circular truncated cone; a digital display circuit board (307) is arranged on a surface of the battery mounting box (301); and an output end of the battery pack (302) is electrically connected to an input end of the digital display circuit board (307).

2. The air pump with the automatic air pumping function according to claim 1, wherein the automatic air replenishing mechanism (3) further comprises a digital display board (308) arranged on a surface of the mounting barrel (4); the digital display board (308) and the digital display circuit board (307) are electrically connected in both directions; an end of the mounting barrel (4) is provided with a switch (309); and the switch (309) is electrically connected to the battery pack (302).

3. The air pump with the automatic air pumping function according to claim 1, wherein an O-ring (310) is arranged on a surface of an end portion of the two-way valve (306); an outer wall of the O-ring (310) is in close contact with the detection box (304); and the O-ring (310) is a rubber material member.

4. The air pump with the automatic air pumping function according to claim 1, wherein a hose (311) is arranged between the two-way valve (306) and the vacuum pump (303), and an end portion of the hose (311) penetrates through the detection box (304).

5. The air pump with the automatic air pumping function according to claim 1, wherein the inner wall of the shell (1) is fixedly connected with two mounting blocks (101); and two L-shaped mounting slots (312) matched with the mounting blocks (101) are formed in the surface of the detection box (304).

6. The air pump with the automatic air pumping function according to claim 1, wherein the negative pressure value of the air pressure sensor (305) ranges from 0 kPa to 90 kPa.

7. The air pump with the automatic air pumping function according to claim 1, wherein the inner wall of the shell (1) is provided with a connecting plate (102); and the connecting plate (102) is connected to one end of the vacuum pump (303).

8. The air pump with the automatic air pumping function according to claim 1, wherein a round hole (401) is formed in a middle position of the other end of the mounting barrel (4), and a size of the round hole (401) is matched with a size of the switch (309).

9. The air pump with the automatic air pumping function according to claim 1, wherein the air pressure sensor (305) is electrically connected to the digital display circuit board (307); and a sensing range of the air pressure sensor (305) is from 0 kPa to 90 kPa at a negative pressure.

* * * * *